US009346065B2

(12) United States Patent
Su

(10) Patent No.: US 9,346,065 B2
(45) Date of Patent: May 24, 2016

(54) DRIVE MECHANISM FOR A SPRINKLER

(71) Applicant: Ho Chin Chen, Taichung (TW)

(72) Inventor: Shian Chun Su, Taichung (TW)

( * ) Notice: Subject to any disclaimer, the term of this patent is extended or adjusted under 35 U.S.C. 154(b) by 218 days.

(21) Appl. No.: 14/264,023

(22) Filed: Apr. 28, 2014

(65) Prior Publication Data

US 2015/0034737 A1 Feb. 5, 2015

(30) Foreign Application Priority Data

Jul. 31, 2013 (TW) ..... 102214327 U

(51) Int. Cl.

| | |
|---|---|
| ***B05B 3/16*** | (2006.01) |
| ***B05B 1/20*** | (2006.01) |
| ***B05B 3/04*** | (2006.01) |
| ***B05B 15/06*** | (2006.01) |

(52) U.S. Cl.

CPC . *B05B 3/16* (2013.01); *B05B 1/205* (2013.01); *B05B 3/0459* (2013.01); *B05B 15/063* (2013.01)

(58) Field of Classification Search

CPC ..... B05B 3/16; B05B 1/205; B05B 3/0459; B05B 15/063

USPC ..... 239/242, 225.1, 237, 240, 246, 247, 239/248, 273, 210

See application file for complete search history.

(56) References Cited

U.S. PATENT DOCUMENTS 7,226,000 B2 * 6/2007 Huang ..... B05B 3/044 239/237

7,284,714 B1 * 10/2007 Wang ..... B05B 1/1663 239/240

* cited by examiner

*Primary Examiner* — Justin Jonaitis

(57) ABSTRACT

A sprinkler includes a hollow shaft to which a positioning part, a gear casing, a pipe are respectively connected to the hollow shaft. The positioning part and the pipe are respectively connected to a first end support and a second end support of a base. The positioning part has multiple grooves defined in a tubular portion thereof. A hollow positioning rod has a ratchet portion which is resiliently formed thereto. The hollow positioning rod is rotatably mounted to the hollow shaft and the ratchet portion is engaged with the grooves of the positioning part. The hollow positioning rod has a toothed portion which is engaged with an output gear of the gear casing. The gear casing is driven by a hydraulic power so as to swing the pipe periodically. The resilient ratchet portion allows the gear casing and the pipe to swing easily, and no metal spring is required.

5 Claims, 8 Drawing Sheets

DRIVE MECHANISM FOR A SPRINKLER

BACKGROUND OF THE INVENTION

1. Fields of the Invention

The present invention relates to a sprinkler, and more particularly, to a drive mechanism for a sprinkler.

2. Descriptions of Related Art

The conventional drive mechanism 9 for a sprinkler is disclosed in FIG. 8 and discloses a hollow shaft 91 to which an end support 92, a gear casing 93 and a hose (not shown) are connected. The whole assembly mentioned above is connected to a base. The end support 92 of the drive mechanism 9 has a hollow positioning rod 921 mounted to the hollow shaft 91. A gear set 922 is connected to one end of the hollow shaft 91 so as to be engaged with the output gear 931 of the gear casing 93. The other end of the positioning rod 921 has an end toothed portion 923 which is engaged with the toothed face 911 of the end support 92. A sleeve 94 and a spring 95 are respectively installed in the hollow positioning rod 921 to provide the gear casing 93 a force to be positioned, so that the sprinkler can stably and periodically spray water. The end support 92 is connected to the gear casing 93 by the hollow shaft 91, when the hydraulic force swings the gear casing 93 and the hose relative to the end support 92, the end toothed portion 923 of the hollow positioning rod 921 is cooperated with the horizontal compression force of the spring 95 to change the positions relative to the toothed face 911 of the end support 92. Therefore, the gear casing 93 and the hose quickly swing back and forth.

The spring 95 is a metal part which is to provide an axial force to support the sleeve 94 to prevent the collar 924 on the end support 92 from being loosened when the water hits the gear casing 93. Once the collar 924 is loosened, the gear casing 93 may not be able to swing.

However, because of the resilient nature of the spring 95, when the end support is connected to the gear casing 93, the hollow shaft 91 is difficult to be secured because of the force from the spring 95. Furthermore, the metal spring 95 increases the manufacturing cost.

The present invention intends to provide a drive mechanism for a sprinkler wherein the structure of the drive mechanism is simplified and no metal spring is required.

SUMMARY OF THE INVENTION

The present invention relates to a sprinkler and comprises a hollow shaft to which a positioning part, a gear casing, and a pipe are respectively connected. A base has a first end support and a second end support. The positioning part is connected to the first end support. The pipe has a pivotal end pivotably connected to the second end support so as to connect the hollow shaft to the base. The positioning part has a tubular portion and multiple grooves are defined in the inner periphery of the tubular portion of the positioning part. A hollow positioning rod has at least one ratchet portion resiliently formed thereto. The hollow positioning rod is inserted into the tubular portion of the positioning part and rotatably mounted to the hollow shaft. The at least one ratchet portion is engaged with the grooves of the positioning part. The hollow positioning rod has a toothed portion on the outside thereof. The toothed portion is engaged with the output gear of the gear casing. The gear casing is driven by a hydraulic power to swing the pipe periodically.

Preferably, two sockets are located between the hollow shaft and the hollow positioning rod. The two socket each have multiple recesses defined in the outside thereof.

Preferably, the hollow positioning rod has an end flange extending inward from one end thereof. A seal ring is located between one of the two sockets and the end flange.

Preferably, the hollow positioning rod has two ratchet portions.

Preferably, the hollow positioning rod is made by plastic. Each of the two ratchet portions is split from a portion of the hollow positioning rod, and two gaps are formed in two sides of each of the two ratchet portions so that each of the two ratchet portions are resilient relative to the hollow positioning rod.

The primary object of the present invention is to provide a drive mechanism of a sprinkler wherein the resilient ratchet portion of the hollow positioning rod allows the gear casing and the pipe to quickly and smoothly swing.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
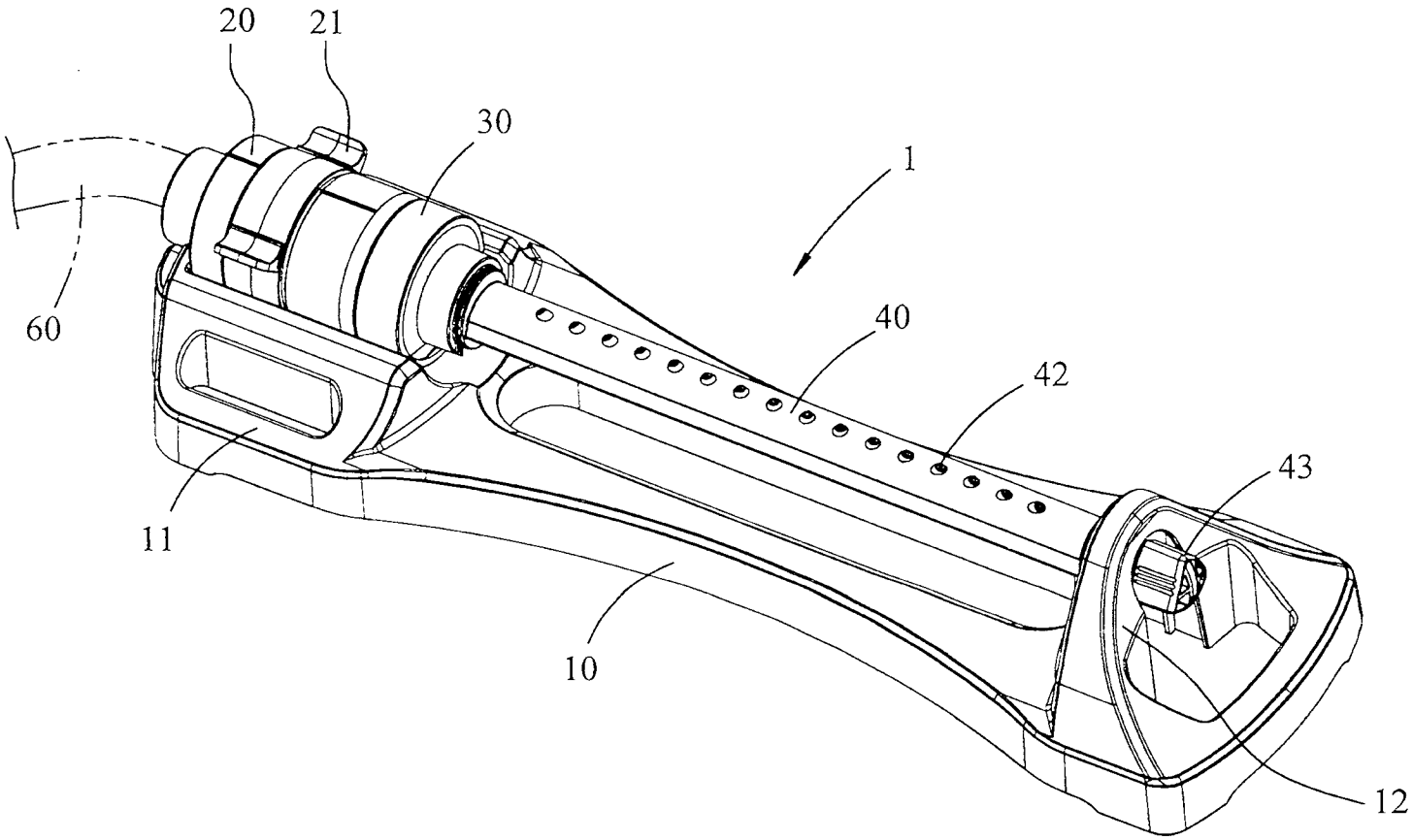
FIG. 1 is a perspective view to show the sprinkler of the present invention.
Figure 2:
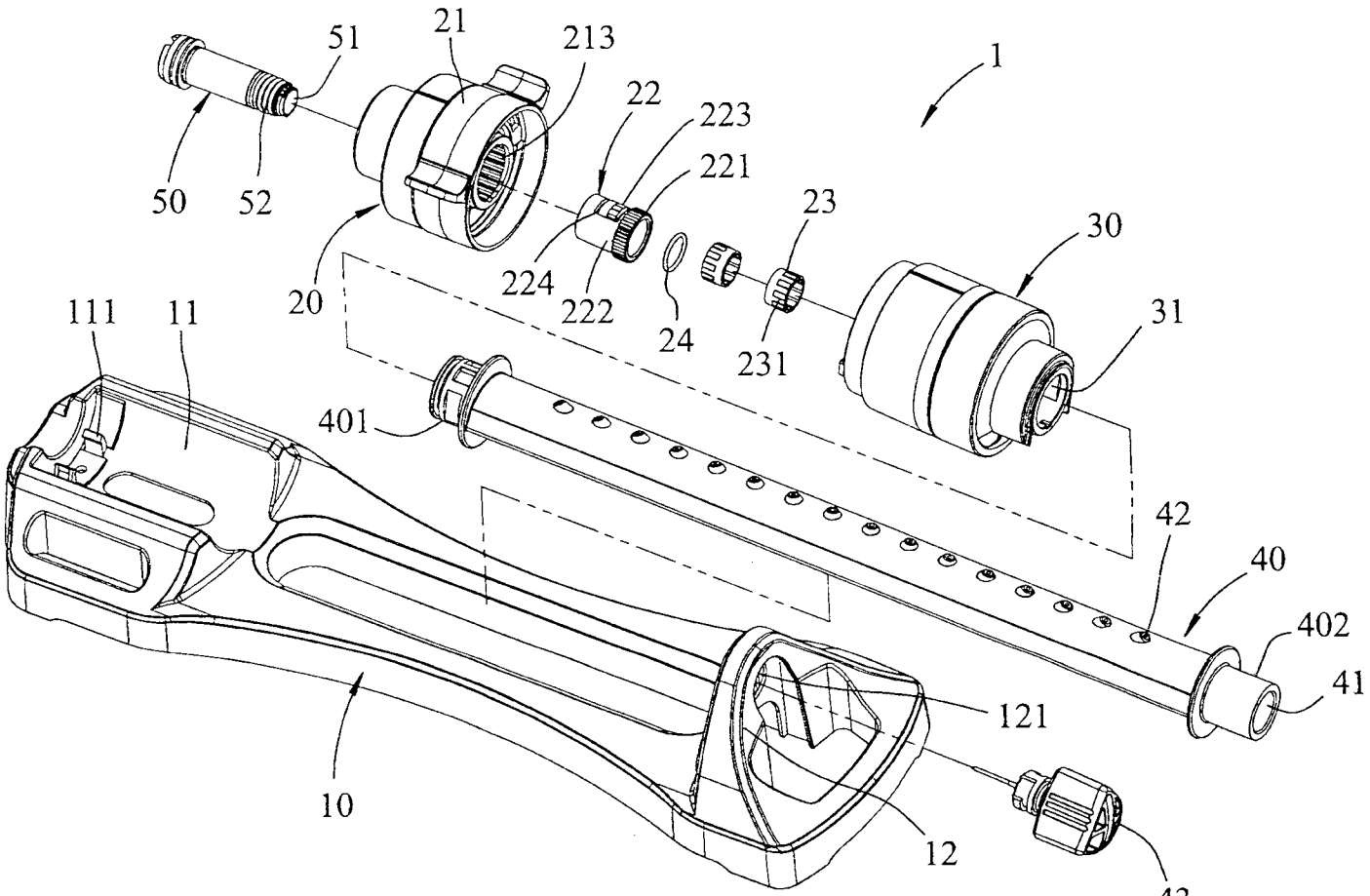
FIG. 2 is an exploded view of the sprinkler of the present invention.
Figure 3:
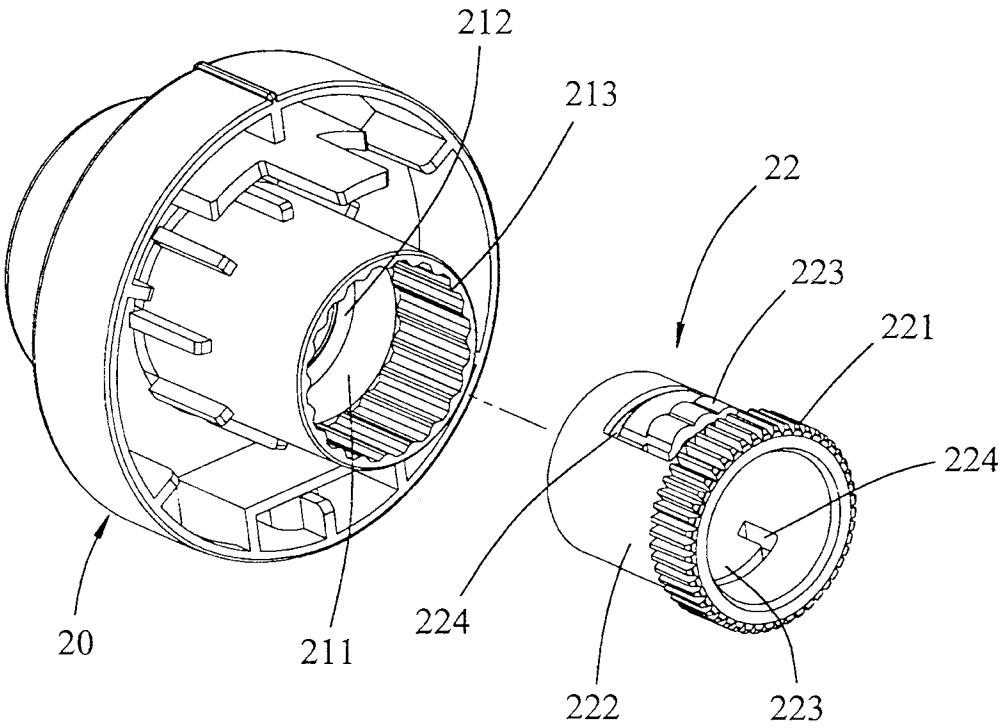
FIG. 3 is an exploded view of the positioning part and the hollow positioning rod of the sprinkler of the present invention.
Figure 4:
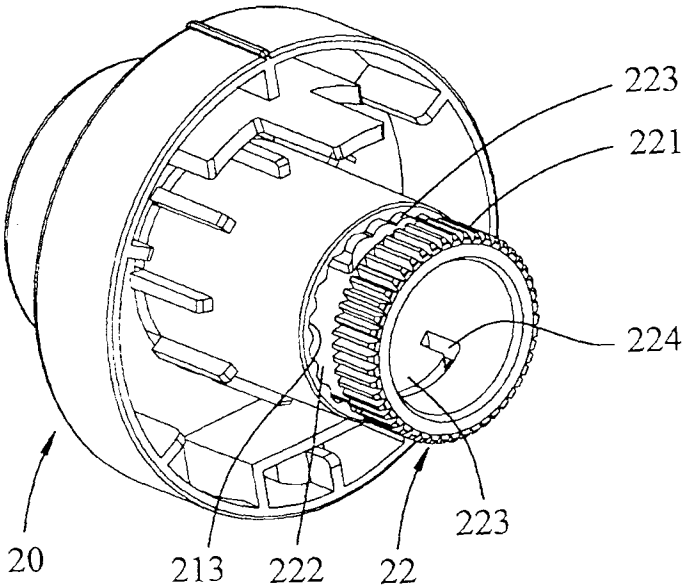
FIG. 4 is a perspective view to show the connection of the positioning part and the hollow positioning rod of the sprinkler of the present invention.

Referring to FIGS. 1 to 5, the sprinkler 1 of the present invention comprises a base 10, a positioning part 20, a gear casing 30, a pipe 40 and a hollow shaft 50. The base 10 comprises a first end support 11 and a second end support 12 extending on two ends thereof, wherein the first end support 11 has an open top and a tab 111 extending from the inside thereof. The second end support 12 has a through hole 121.

The positioning part 20 is a tubular part and has a collar 21 mounted thereto. A water inlet path 211 is defined axially through the positioning part 20. A flange 212 extends from the inner periphery of the water inlet path 211 to define the water inlet path 211 into an inner chamber and an outer chamber. The positioning part 20 has a tubular portion and multiple grooves 213 are defined in the inner periphery of the tubular portion of the positioning part 20. The collar 21 is located around the tubular portion. The underside of the positioning part 20 is secured to the tab 111 of the first end support 11.

The hollow positioning rod 22 extends into the inner chamber and has a toothed portion 221 on the outside thereof. A tubular body 222 extends from an end of the hollow positioning rod 22 and has at least one ratchet portion 223 resiliently formed thereto. The at least one ratchet portion 223 is engaged with the grooves 213 of the positioning part 20. When the hollow positioning rod 22 is rotated relative to the grooves 213, the at least one ratchet portion 223 is resilient so that the hollow positioning rod 22 is resiliently engaged with the grooves 213. In detail, the at least one ratchet portion 223 is split from a portion of the hollow positioning rod 22, and two gaps 224 are formed in two sides of the at least one ratchet portion 223 so that the at least one ratchet portion 223 is resilient relative to the hollow positioning rod 22.

The gear casing 30 is a hollow easing and has an axial path 31 through which water flows. A reduction gear set 32 is connected to the axial path 31 so that the water drives the reduction gear set 32 to transfer a force to the output gear 33 of the gear casing 30. Because the toothed portion 221 of the hollow positioning rod 22 is engaged with the output gear 33, such that the gear casing 30 periodically swings relative to the toothed portion 221 of the hollow positioning rod 22 when the water drives the gear casing 30 while the gear casing 30 is restricted by the restriction rod 34.

The pipe 40 has a passage 41 defined axially therethrough and multiple nozzles 42 are defined through the wall of the pipe 40. The pipe 40 has a connection end 401 which is connected to the gear casing 30 so that the pipe 40 is co-rotatable with the gear casing 30. The pipe 40 further has a pivotal end 402 which extends through the through hole 121 of the second end support 12 of the base 10. An end cap 43 is mounted to the pivotal end 402.

The hollow shaft 50 has a central path 51 and a connection portion 52 is formed on one end of the hollow shaft 50. The hollow shaft 50 extends through the water inlet path 211 of the positioning part 20 so that the connection portion 52 is connected to the inlet of the axial path 31 of the gear casing 30 to position the positioning part 20, the gear casing 30 and the pipe 40.

Figure 5:
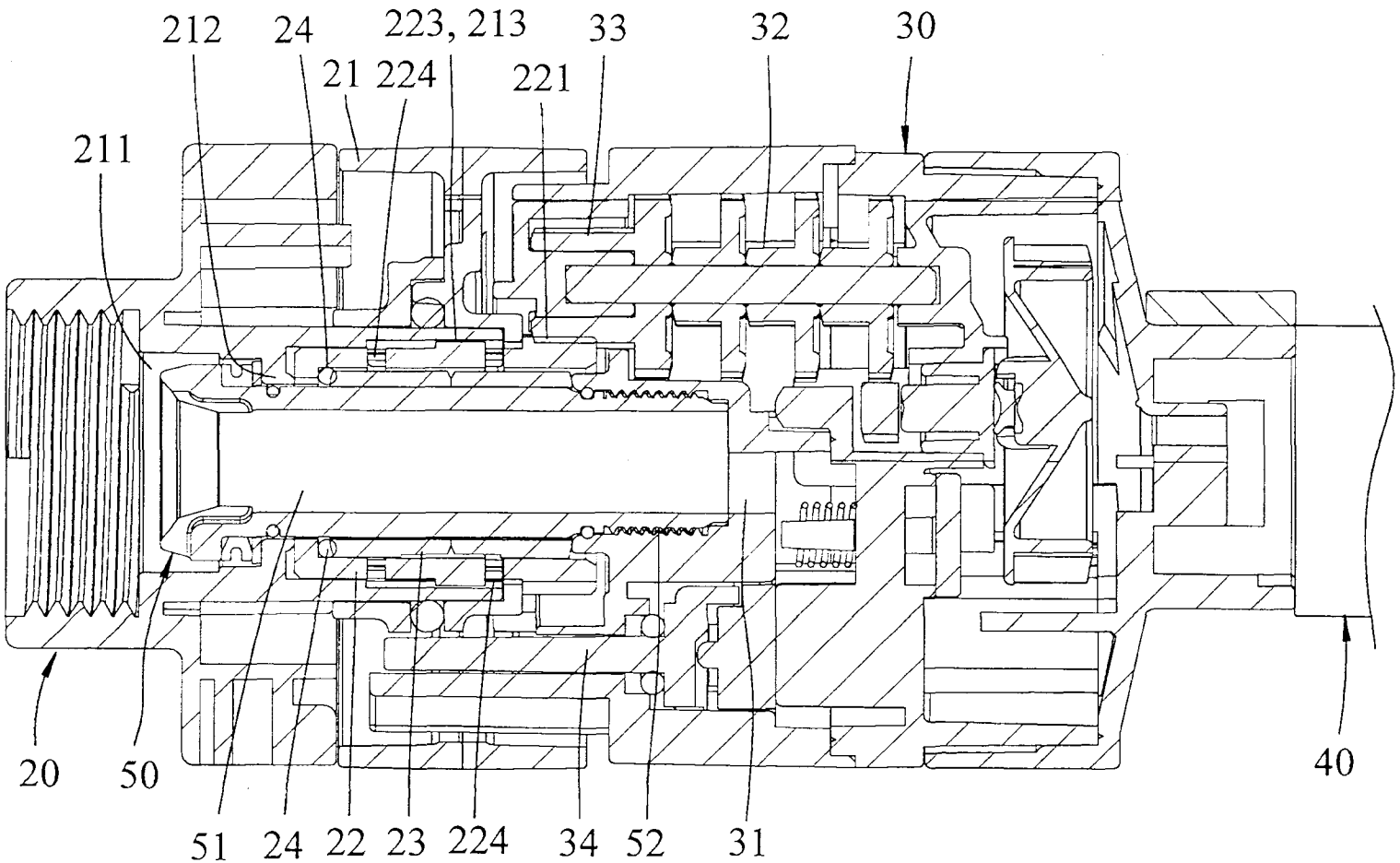
FIG. 5 is a cross sectional view of the sprinkler of the present invention.
Figure 6:
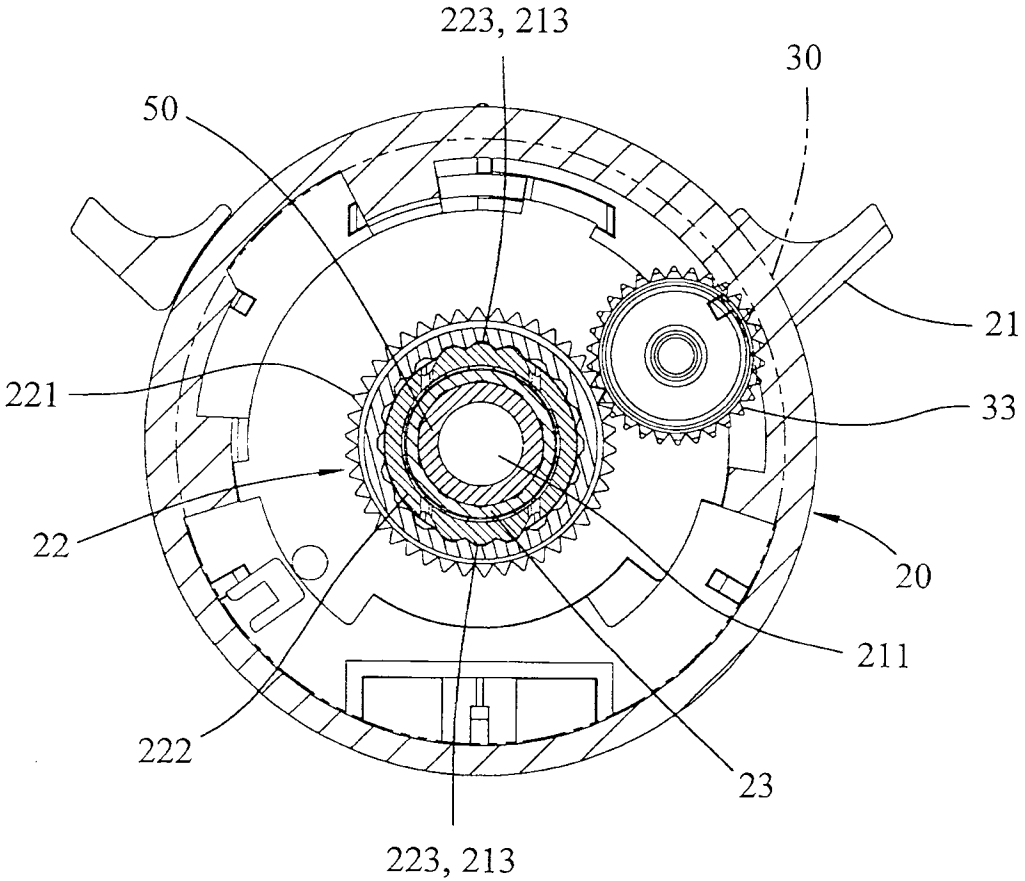
FIG. 6 shows an end cross sectional view of the operation of the sprinkler of the present invention.
Figure 7:
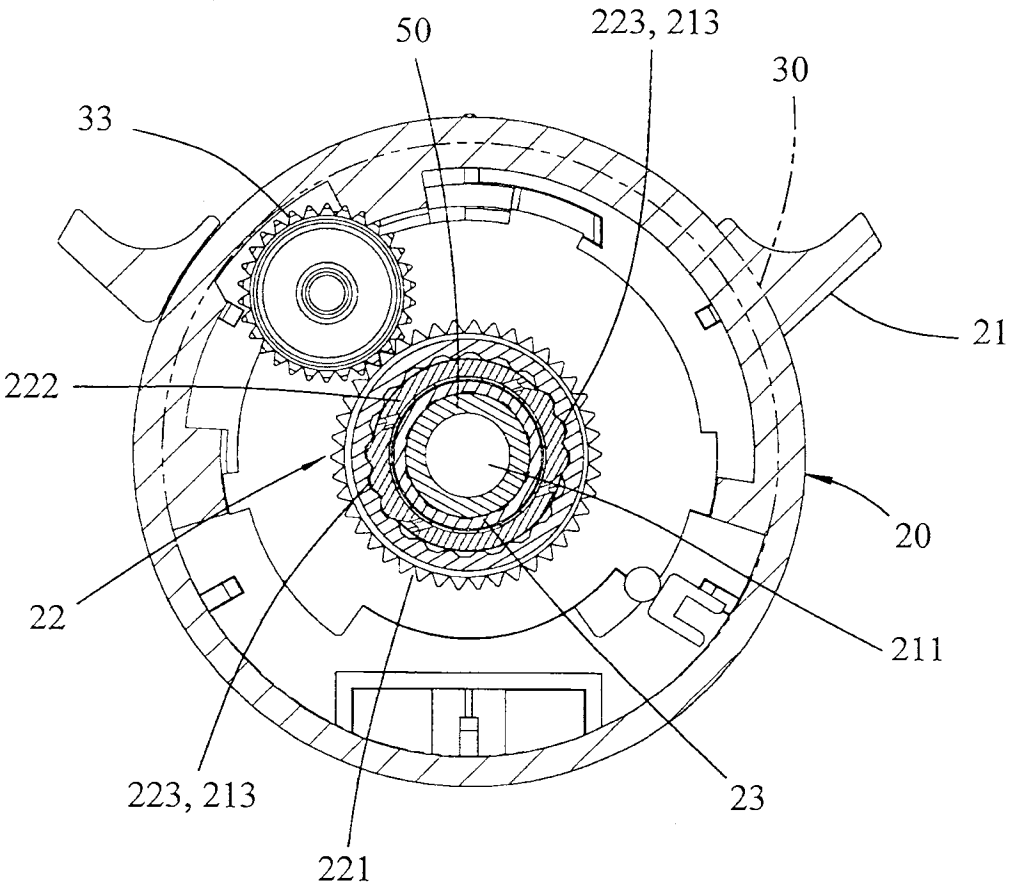
FIG. 7 shows another end cross sectional view of the operation of the sprinkler of the present invention.
Figure 8:
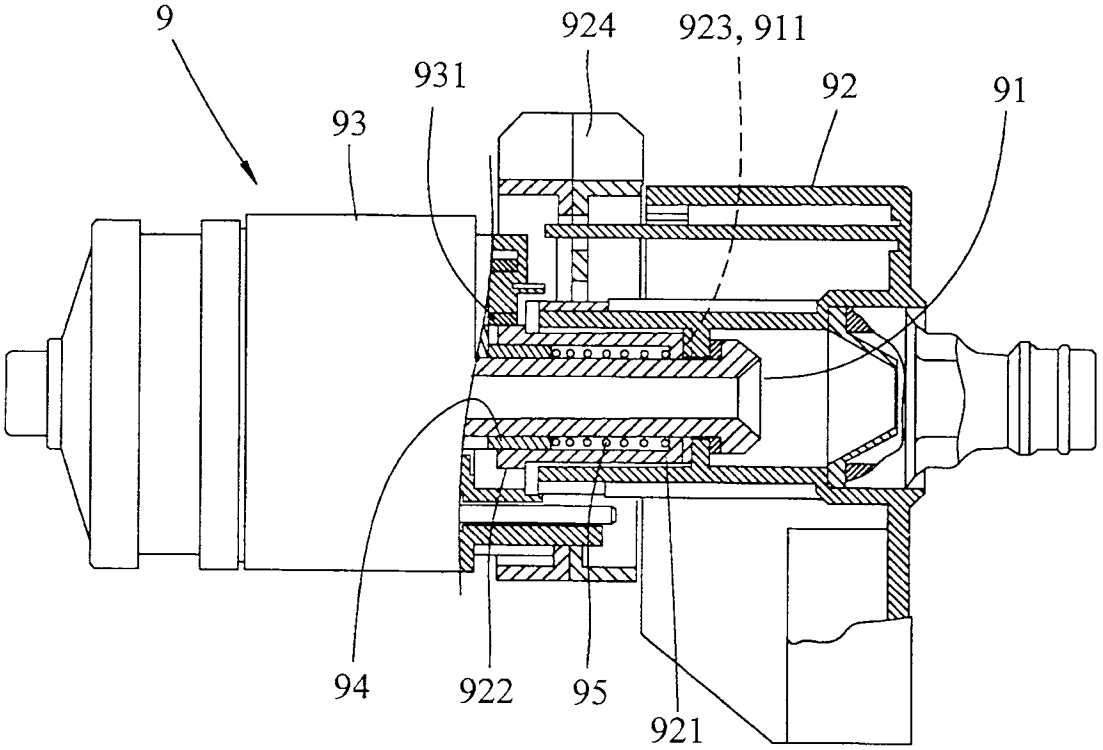
FIG. 8 PRIOR ART
FIG. 8 is a partial cross sectional view of a conventional sprinkler.

As shown in FIGS. 5 to 7, the combination of the hollow shaft 50, the positioning part 20, the gear casing 30 and the pipe 40 are connected to the first and second end supports 11, 12 to form the sprinkler 1. The hollow positioning rod 22 is rotatably connected to the hollow shaft 50, and the output gear 33 of the gear casing 30 is engaged with the toothed portion 221 of the hollow positioning rod 22. The water inlet path 211, the axial path 31 and the passage 41 form the water path.

A hose 60 is connected to the water inlet path 211 so that water flows from the water source and passes through the water inlet path 211 and the axial path 31 and drives the reduction gear set 32 of the gear casing 30. The water in the water path is driven to transfer the force to the output gear 33. The output gear 33 swings relative to the toothed portion 221 of the hollow positioning rod 22, such that the gear casing 30 and the pipe 40 simultaneously swing relative to the base 10. The water sprays from the nozzles 42 of the pipe 40.

When the sprinkler 1 does not swing to the desired direction and position, the user can force the gear casing 30 and the pipe 40 to the desired direction and position. Because the positioning part 20 is fixed to the first end support 11 of the base 10, when the user forces the gear casing 30 to swing, because the resistance of the output gear 33 is significant so that the toothed portion 221 of the hollow positioning rod 22 is co-rotated. When the hollow positioning rod 22 is rotated, the at least one ratchet portion 223 is pushed inward relative to the grooves 213 because of the gaps 224, so that the gear casing 30 and the pipe 40 are quickly adjusted to the desired direction and position relative to the positioning part 20. When the pipe 40 is rotated to the desired position and direction, the at least one ratchet portion 223 is engaged with the grooves 213 again. The gear casing 30 and the pipe 40 are operated to the desired direction and position as shown in FIGS. 6 and 7.

In order to reduce the friction between the hollow positioning rod 22 and the hollow shaft 50, two sockets 23 are located between the hollow shaft 50 and the hollow positioning rod 22. The two socket 23 each have multiple recesses 231 defined in the outside thereof to reduce the friction area. There is a gap between the sockets 23 and the at least one ratchet portion 223 of the hollow positioning rod 22, so that the at least one ratchet portion 223 is allowed to be pushed inward and the rotation of the pipe 40 is smooth. The hollow positioning rod 22 has an end flange extending inward from one end thereof, a seal ring 24 is located between one of the two sockets 23 and the end flange. The seal ring 24 has elasticity so that when the water hits the gear casing 30, the two sockets 23 urge the seal ring 24 so that the sockets 23 do not loose. The present invention does not need any metal spring. The direction and position of the gear casing 30 and the pipe 40 can be easily changed.

While we have shown and described the embodiment in accordance with the present invention, it should be clear to those skilled in the art that further embodiments may be made without departing from the scope of the present invention.

What is claimed is:

1. A sprinkler (1) comprising:

a hollow shaft (50);

a positioning part (20), a gear casing (30), a pipe (40) respectively connected to the hollow shaft (50), and a base (10) having a first end support (11) and a second end support (12), the positioning part (20) connected to the first end support (11), the pipe (40) having a pivotal end (402) which is pivotably connected to the second end support (12) so as to connect the hollow shaft (50) to the base (10), the positioning part (20) having a tubular portion and multiple grooves (213) defined in an inner periphery of the tubular portion of the positioning part (20), a hollow positioning rod (22) having at least one ratchet portion (223) resiliently formed thereto, the hollow positioning rod (22) inserted into the tubular portion of the positioning part (20) and rotatably mounted to the hollow shaft (50), the at least one ratchet portion (223) being engaged with the grooves (213) of the positioning part (20), the hollow positioning rod (22) having a toothed portion (221) on an outside thereof and the toothed portion (221) being engaged with an output gear (33) of the gear casing (30), the gear casing (30) being driven by a hydraulic power so as to swing the pipe periodically.

2. The sprinkler as claimed in claim 1, wherein two sockets (23) are located between the hollow shaft (50) and the hollow positioning rod (22), the two socket (23) each have multiple recesses (231) defined in an outside thereof.

3. The sprinkler as claimed in claim 2, wherein the hollow positioning rod (22) has an end flange extending inward from one end thereof, a seal ring (24) is located between one of the two sockets (23) and the end flange.

4. The sprinkler as claimed in claim 1, wherein the hollow positioning rod (22) has two ratchet portions (223).

5. The sprinkler as claimed in claim 4, wherein the hollow positioning rod (22) is made by plastic, each of the two ratchet portions (223) is split from a portion of the hollow positioning rod (22), two gaps (224) are formed in two sides of each of the two ratchet portions (223) so that each of the two ratchet portions (223) are resilient relative to the hollow positioning rod (22).

* * * * *